US010677202B2

(12) United States Patent
Osip et al.

(10) Patent No.: US 10,677,202 B2
(45) Date of Patent: Jun. 9, 2020

(54) SYSTEM FOR EXHAUST GAS RECIRCULATION TUBE ALIGNMENT

(71) Applicant: Ford Global Technologies, LLC, Dearborn, MI (US)

(72) Inventors: Sandra Osip, Livonia, MI (US); Keith Haven, Westland, MI (US); Jeffrey Stancavage, Chesterfield Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 115 days.

(21) Appl. No.: 15/937,410

(22) Filed: Mar. 27, 2018

(65) Prior Publication Data

US 2019/0301404 A1 Oct. 3, 2019

(51) Int. Cl.

| | |
|---|---|
| ***F02M 26/12*** | (2016.01) |
| ***F02M 26/17*** | (2016.01) |
| ***F02M 26/13*** | (2016.01) |
| ***F02M 26/20*** | (2016.01) |
| *F02M 26/11* | (2016.01) |
| *F02M 26/05* | (2016.01) |

(52) U.S. Cl.

CPC ..... *F02M 26/12* (2016.02); *F02M 26/13* (2016.02); *F02M 26/17* (2016.02); *F02M 26/20* (2016.02); *F02M 26/05* (2016.02); *F02M 26/11* (2016.02)

(58) Field of Classification Search

CPC ..... F02M 26/12; F02M 26/17; F02M 26/11; F02M 26/13; F02M 26/20; F02M 26/23; F02M 26/05; F02M 35/10222

USPC ..... 123/568.11

See application file for complete search history.

(56) References Cited

U.S. PATENT DOCUMENTS

| | | | | |
|---|---|---|---|---|
| 4,960,296 | A * | 10/1990 | Thelen | F16L 25/026 285/179 |
| 5,158,061 | A * | 10/1992 | Monteith | F16L 27/1004 123/568.11 |
| 5,174,612 | A * | 12/1992 | Schnell | F16L 41/086 285/49 |
| 5,201,549 | A * | 4/1993 | Davey | F16L 37/091 285/39 |
| 5,425,347 | A | 6/1995 | Zinke, II | |
| 5,433,183 | A * | 7/1995 | Vansnick | F16L 37/008 123/568.11 |
| 5,609,144 | A * | 3/1997 | Seizew | F16L 27/044 123/568.11 |
| 6,244,255 | B1 * | 6/2001 | Sagata | F02M 35/10052 123/568.11 |
| 6,810,865 | B2 * | 11/2004 | Hewkin | F16L 23/12 123/568.11 |

(Continued)

FOREIGN PATENT DOCUMENTS

WO 2017099259 A1 6/2017

*Primary Examiner* — Hung Q Nguyen
*Assistant Examiner* — Susan E Scharpf
(74) *Attorney, Agent, or Firm* — Geoffrey Brumbaugh; McCoy Russell LLP

(57) ABSTRACT

Systems are provided for aligning and assembling an exhaust gas recirculation (EGR) assembly with an engine intake housing. In one example, an intake system may include an EGR port housing for coupling the EGR assembly on an intake housing. The EGR port housing may include one or more alignment tabs on at least one side of the EGR port housing for aligning and guiding the EGR assembly during installation onto the intake housing.

20 Claims, 7 Drawing Sheets

(56) References Cited

U.S. PATENT DOCUMENTS

| | | | | |
|---|---|---|---|---|
| 6,874,487 | B2 * | 4/2005 | Murphy | F02M 35/10222 123/568.17 |
| 6,935,321 | B1 * | 8/2005 | Sullivan | F02M 35/10222 123/568.17 |
| 7,032,579 | B2 | 4/2006 | Nishida et al. | |
| 9,322,364 | B2 | 4/2016 | Keating et al. | |
| 2001/0017033 | A1 * | 8/2001 | McKinley | F02B 29/0406 60/605.2 |
| 2004/0040549 | A1 * | 3/2004 | Murphy | F02M 35/10222 123/568.17 |
| 2010/0122693 | A1 * | 5/2010 | Braun | F02M 35/10222 123/568.17 |
| 2012/0031364 | A1 * | 2/2012 | Schweiger | F02M 35/10085 123/184.21 |
| 2015/0377186 | A1 * | 12/2015 | Blanchard | F02B 29/0406 123/542 |

* cited by examiner

SYSTEM FOR EXHAUST GAS RECIRCULATION TUBE ALIGNMENT

FIELD

The present description relates generally to an engine system with an exhaust gas recirculation system.

BACKGROUND/SUMMARY

Engine systems, including naturally aspirated engines and boosted engines, utilize exhaust gas recirculation (EGR), where a portion of exhaust gases is recirculated into the intake, to reduce emission from the engine and/or improve fuel economy. In boosted engine systems that utilize compressors in the intake system to provide boosted air charge, the EGR can be delivered in a "high pressure" (HP) loop, where the EGR gases are taken before the turbine and injected after the compressor, or a "low pressure" (LP) loops, where the EGR gases are taken after the turbine and injected before the compressor. The engine systems with EGR include an EGR port in the intake for admitting the EGR gases. The intake housing typically includes a mounting surface for locating the EGR port and installing an EGR tube assembly onto the intake housing.

An example intake housing configuration is shown by Murphy in U.S. Pat. No. 6,874,487. Therein, the intake housing includes an extending boss for receiving an EGR tube assembly and the boss further includes boss extensions. An attachment portion of the EGR tube assembly includes a pair of tabs that are aligned with the boss extensions, and the EGR tube is coupled with the intake housing via fasteners inserted through openings in the tabs and boss extensions.

However, the inventors herein have recognized potential issues with such systems. As one example, during installation of the EGR tube assembly into the intake, the EGR tube assembly may be mis-aligned with the intake housing and coupled without detecting and correcting the mis-alignment. As a result, the EGR tube assembly may be improperly coupled without establishing a tight seal between the EGR tube assembly and the intake housing. Consequently, when EGR gases are delivered from the EGR tube into the intake manifold, leakages can occur. As a result, the assembled intake and EGR tube unit may not pass development and/or end of the line testing, which may lead to delay in delivering the final product. In some examples, the improper assembling may establish a temporary seal and thus, may not be detected during testing and development. However, during subsequent vehicle operation, the temporary seal may not hold, resulting in leakage of gases, and consequently, vehicle performance and emission degradation issues. Furthermore, in some cases, the positioning of the EGR tube assembly may be improper. For example, the EGR tube assembly may be rotated 180 degrees with respect to the correct position. An intake system such as Murphy's does not provide any indication for the incorrect direction of the EGR tube assembly. As a result, the EGR tube may be incorrectly installed, which renders the assembled product unfit for assembly with the engine. This leads to manufacturing delays.

In one example, the issues described above may be addressed by an intake system for an engine, comprising: an intake plenum enclosed by an intake plenum housing; and an exhaust gas recirculation (EGR) port for admitting exhaust gases recirculated by an EGR system into the intake plenum; wherein the EGR port is enclosed by an EGR port housing including a central boss, one or more housing extensions, and one or more alignment tabs, each alignment tab positioned on one side of each housing extension.

In this way, by providing one or more alignment tabs on the EGR port housing, an EGR assembly may be aligned more accurately with the intake housing during the assembly process. Further, the one or more alignment tabs are configured such that the tabs permit coupling of the EGR assembly with the intake only if the EGR assembly is correctly aligned with the EGR port housing on the intake, thereby preventing fastening of the EGR assembly with the intake if mis-aligned.

As one example, an EGR port for delivering EGR gases to the intake is enclosed by an EGR port housing. During an assembly process, an EGR tube assembly is aligned with the EGR port housing via one or more alignment tabs on the EGR port housing and coupled to form an intake-EGR tube unit. Specifically, the EGR port housing includes a central boss for receiving an EGR tube portion of the EGR tube assembly. Further, the EGR port housing includes housing extensions on opposite sides of the central boss. Each housing extension includes an opening for receiving a fastener. Furthermore, the EGR port housing includes one or more alignment tabs, each alignment tab corresponding to each housing extension on one side of the housing extension for guiding and aligning fastener holes on a flange of the EGR tube assembly with the openings on the housing extensions. In one example, each alignment tab extends below each housing extension, each housing extension positioned on opposite sides of the central boss. Further, each alignment tab includes a step-like protrusion on a front side of the EGR port housing, which provides a mounting and aligning surface for the EGR tube assembly. Specifically, during assembly process, the EGR tube portion of the EGR tube assembly is inserted into the central boss, and the flange of the EGR tube assembly is positioned on the step-like protrusion of the alignment tab, and guided to align the fastener holes on the flange with the openings on the housing extensions. Subsequently, fasteners may be inserted through the fastener holes and the openings on the housing extensions to couple the EGR tube assembly with the EGR pot housing on the intake.

If the EGR tube assembly is positioned correctly with respect to the EGR port housing, the alignment tabs guide the EGR tube assembly such that the fastener holes on the flange of the assembly align with the openings on the housing extensions. Once aligned, the EGR tube assembly may be coupled with the EGR port housing. However, if the EGR tube assembly is incorrectly positioned (e.g., rotated 180 degrees), the alignment tabs prevent alignment of the fastener holes and the openings. As a result, it may not be possible to insert the fastener through the fastener holes and housing extensions. Consequently, incorrect installation of the EGR tube assembly is prevented. Further, when positioned correctly, by using the alignment tabs, the fastener holes and the openings may be aligned with reduced adjustments. Furthermore, by using the alignment tabs for EGR assembly installation, mis-alignment is reduced as the alignment tabs greatly reduce the potential number of mis-aligned positions. In this way, by guiding alignment of the EGR tube assembly with the EGR port housing, and by providing directional guidance for positioning of the EGR tube assembly with the EGR port housing, the alignment tabs reduce time to assemble the EGR tube assembly. Furthermore, by ensuring proper alignment, improper coupling between the EGR tube assembly and the EGR port housing is reduced. As a result, proper sealing between the EGR tube and the intake is maintained during the vehicle lifecycle.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-9 are shown approximately to scale.

DETAILED DESCRIPTION

Figure 1:
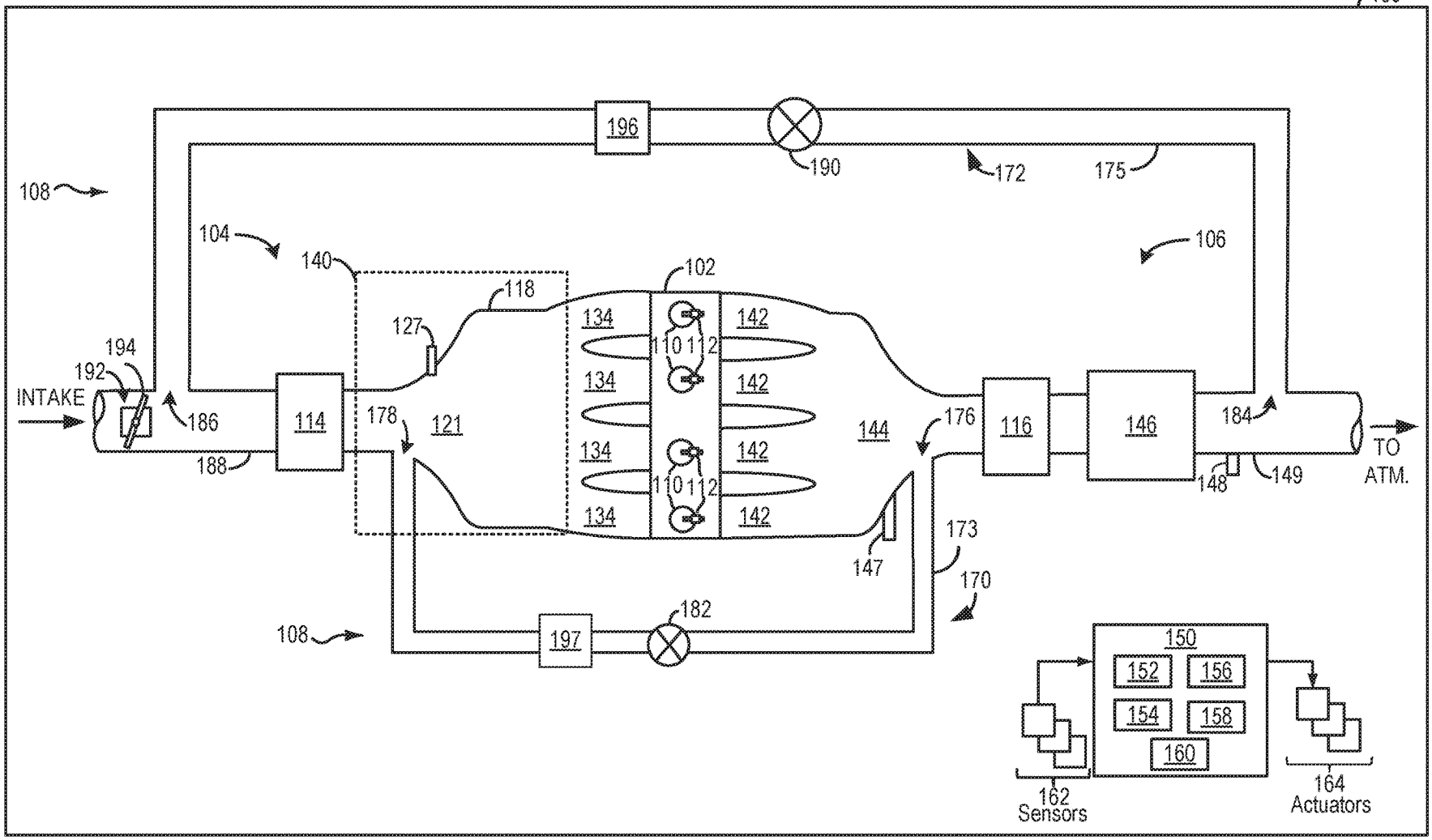
FIG. 1 illustrates a schematic depiction of an example vehicle including an engine, intake system, and exhaust system.
Figure 2:
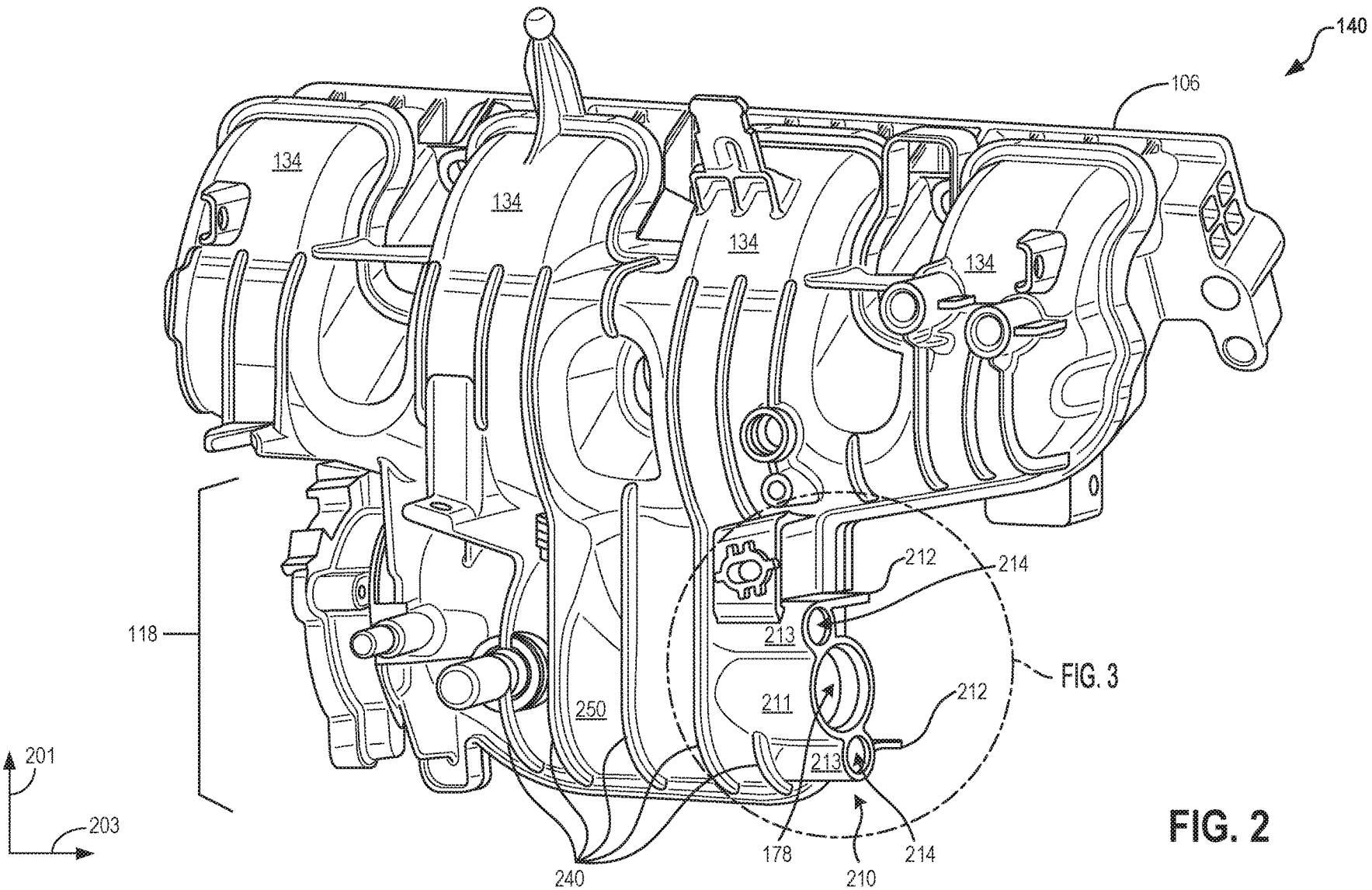
FIG. 2 shows a perspective view of a portion of an engine intake assembly including an EGR port housing.
Figure 3:
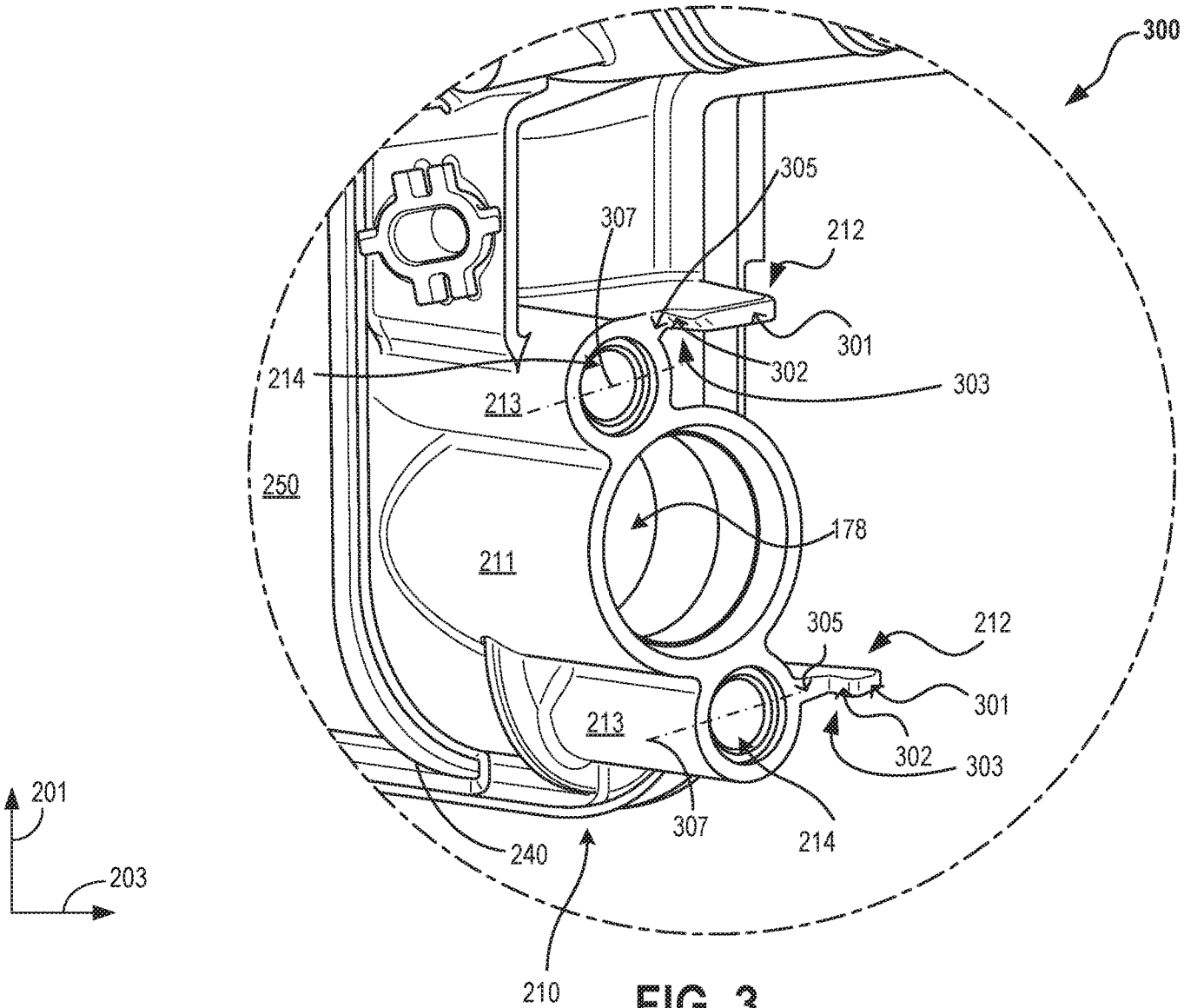
FIG. 3 shows an enlarged view of the EGR port housing of FIG. 2.

The following description relates to installation of an exhaust gas recirculation (EGR) tube assembly with an intake of a vehicle system, such as the vehicle system in FIG. 1. Specifically, the following description relates to installation features on an intake housing (which may be an intake manifold housing or an intake plenum housing) of an engine of the vehicle for aiding alignment and installation of the EGR tube assembly with the intake housing during an assembly process. For example, during manufacturing/development phase of a vehicle life-cycle, particularly, during installation of the EGR tube assembly with the intake housing, mis-alignment of the EGR tube assembly with the intake housing may lead to improper coupling between the EGR tube assembly and the intake manifold housing. Thus, a tight seal between the EGR tube assembly and the intake housing may not be established. Consequently, when EGR gases are delivered from the EGR tube into the intake, leakages can occur. As a result, the assembled intake and EGR tube unit may not pass development and/or end of the line testing during a testing phase of the vehicle life-cycle, which may lead to delay in delivering the final product. In some examples, during subsequent vehicle operation, the improper sealing may cause vehicle performance and emission issues due to leakage of gases. In order to reduce time to assemble the EGR tube assembly and maintain proper sealing between the EGR tube and the intake, an EGR outlet port housing is provided on the intake housing with one or more alignment tabs adjoining one or more attachment openings. Specifically, the EGR outlet port housing includes one or more EGR tube alignment tabs for aligning the EGR tube with the outlet port, and one or more EGR tube attachment openings for fastening the EGR tube assembly to the EGR outlet port housing. A portion of the intake including the EGR outlet port housing including the one or more alignment tabs and the one or more attachment openings is shown in FIG. 2. An enlarged view of the EGR outlet port housing with the alignment tabs is shown in FIG. 3. Further, FIGS. 4-9 illustrate the alignment and attachment of the EGR tube assembly with the EGR outlet port housing via the alignment tabs. In this way, by implementing an EGR port housing with one or more alignment tabs, the technical result of correct directional positioning of the EGR tube assembly with the EGR port housing, and proper alignment of the EGR tube assembly with the EGR port housing is achieved. Additional technical results include faster assembly of the EGR tube assembly with the EGR port housing and tight consistent sealing between EGR tube assembly and the EGR port housing.

Turning to FIG. 1, it shows a schematic depiction of a vehicle 100 including an engine 102, an intake system 104, an exhaust system 106, and an exhaust gas recirculation (EGR) system 108. The intake system 104 is configured to provide intake air to cylinders 110 in the engine 102. The engine is depicted as having four cylinders arranged in an inline configuration. However, it will be appreciated that the number of cylinders and/or configuration of the cylinders may be altered in other embodiments. For example, the engine 102 may include six cylinders arranged in a V-configuration. The intake system 104 is configured to flow intake air to the cylinders and the exhaust system 106 is configured to receive exhaust gas from the cylinders. Additionally, each of the cylinders 110 may include an ignition device 112 configured to ignite an air fuel mixture in the cylinders 110. Additionally or alternatively, compression ignition may be utilized to ignite the air fuel mixture in the cylinders 110. The engine 102 also includes at least one intake and exhaust valve per cylinder.

The intake system includes a compressor 114. The compressor 114 may be included in a turbocharger having a turbine 116 in the exhaust system 106. The compressor 114 and the turbine 116 are rotatably coupled. However, in other examples the compressor 114 may be rotatably coupled to a transmission in the vehicle, providing what is referred to as supercharging.

The intake system 104 includes an intake assembly 140 comprising an intake plenum 118 (hereinafter referred to as plenum 118). Plenum 118 may include a charge air cooler (CAC) (not shown) integrated therein. The charge air cooler may be used to cool intake air, which may be heated via operation of the compressor 114 and the EGR gas delivered to the intake system 104 upstream of the plenum 118. The plenum 118 may include an inlet (not shown) in fluidic communication with the compressor 114. The plenum 118 further includes a plenum enclosure 121. In this configuration, the cross-sectional area in the plenum enclosure 121 perpendicular to the general direction of airflow is shown increasing in a downstream direction. Thus, the plenum enclosure 121 includes an expansion and the volume of a plenum enclosure expands in a downstream direction. Further, a pressure sensor 127 may be positioned in a pressure sensor port in the plenum 118. The pressure sensor 127 may provide an indication of manifold pressure to an engine controller 150, discussed further below.

The intake assembly 140 further includes an EGR port 178 (alternatively referred to as EGR outlet port 178), downstream of the compressor 114 in the direction of intake air flow. The EGR gases from a high-pressure (HP) EGR circuit (discussed below) is delivered to the plenum enclosure 121 via the EGR outlet port 178.

The EGR port 178 is enclosed by an EGR port housing integratively coupled with an intake plenum housing enclosing the intake plenum 118 and enclosure 121. It may be noted that the EGR port in the intake may be alternatively referred to as EGR outlet port. Thus, the terms EGR port and EGR outlet port may be interchangeably used. Further, it may be noted that the EGR port housing coupled to the intake plenum housing may be alternatively referred to as EGR outlet port housing. Thus, the terms EGR outlet port housing and EGR port housing may be interchangeably used.

During a manufacturing phase of the vehicle, an EGR tube assembly including an EGR tube 173 for recirculating the EGR gases from a high-pressure (HP) EGR circuit (discussed below) is coupled to the EGR outlet port housing via one or more alignment tabs provided on the EGR outlet port housing. The alignments tabs are utilized for guidance and alignment of the EGR tube assembly with the EGR port housing during installation. The alignment tabs also provide directional positioning and reduce mis-alignment of the EGR tube assembly during installation. In this way, the alignment tabs reduce installation time while providing alignment and reducing improper installation of the EGR tube assembly. Details of the EGR port housing including the alignment tabs will be further discussed with respect to FIGS. 2-9, which show various perspective views of portions of the intake assembly 140 including the EGR outlet 178 and the EGR outlet port housing.

The intake system 104 further includes a plurality of intake runners 134. Each intake runner 134 is in fluidic communication with one of the cylinders 110.

The exhaust system 106 includes a plurality of exhaust runners 142 in fluidic communication with the cylinders 110 and an exhaust manifold 144. The turbine 116 is positioned downstream of the exhaust manifold 144 in the exhaust system 106. Additionally, an emission control device 146 is positioned downstream of the turbine 116. The turbine 116 is rotatably coupled to the compressor 114. A shaft or other suitable component may be utilized to couple the turbine 116 and the compressor 114. However, in other examples the turbine 116 may be omitted from the engine and rotational energy from a transmission in the vehicle 100 may be used to provide rotational energy to the compressor 114. A pressure sensor 147 may be coupled to the exhaust manifold 144. An oxygen sensor 148 may be coupled to an exhaust passage 149 downstream (in the direction of exhaust flow) of the emission control device 146.

The EGR system 108 may include at least one of a high pressure EGR loop 170 and a low pressure EGR loop 172. The charge air cooler allows for better control of low pressure EGR loop 172 and improves the cooling of the high pressure EGR loop 170. The high pressure EGR loop 170 includes an EGR tube 173, an EGR inlet port 176 opening into the exhaust manifold 144, and an EGR outlet port 178 opening into the plenum 118. The specific geometric features of the intake plenum 118 including the EGR outlet port 178 are discussed in greater detail herein with regard to FIGS. 2-9. In some examples, the EGR outlet 178 may open into a conduit (not shown) fluidly coupling the compressor 114 to the plenum 118. A high pressure EGR valve 182 may be included in the high pressure EGR loop 170. In an open position, the valve 182 is configured to enable gas to flow through the high pressure EGR loop 170. In a closed position, the valve 182 is configured to substantially inhibit gas from flowing through the high pressure EGR loop 170.

The low pressure EGR loop 172 includes an inlet 184 opening into the exhaust passage 149 and an outlet port 186 opening into an intake passage 188 upstream of the compressor 114 in the intake system 104. The outlet port 186 may be similar to the EGR outlet port 178. Thus, an outlet port housing enclosing the outlet port 186 may be similar to the EGR outlet port housing discussed herein, and illustrated in FIGS. 2-9. Thus, while the outlet port and the outlet port housing shown in FIGS. 2-9 are discussed with respect to the outlet port 178 and its corresponding housing, it will be appreciated that all the features of the EGR outlet port 178 and the EGR outlet port housing, including the alignment tabs, are applicable to outlet port 186 and its corresponding outlet port housing. Thus, in one example, the outlet port 186 may be enclosed in an outlet port housing including one or more alignment tabs, which may be utilized for guiding and aligning a LP EGR assembly including a LP-EGR tube 175 with the intake housing.

A low pressure EGR valve 190 may be included in the low pressure EGR loop 172. In an open position, the valve 190 is configured to enable gas to flow through the low pressure EGR loop 172. In a closed position, the valve 190 is configured to substantially inhibit gas from flowing through the low pressure EGR loop 172. In this way, gas may be flowed from the exhaust system 106 to the intake system 104 via the high pressure EGR loop 170 and the low pressure EGR loop 172. For both the high pressure EGR loop 170 and the low pressure EGR loop 172, coolers 197 and 196 may be included to provide initial EGR cooling before the mixed air and EGR gases traverse the charge air cooler in the plenum 118.

The intake passage 188 includes a throttle 192 having a throttle plate 194. In this example, the position of throttle plate 194 may be varied by a controller 150 via a signal provided to an electric motor or actuator included with throttle 192, a configuration that is commonly referred to as electronic throttle control (ETC). In this manner, throttle 192 may be operated to vary the intake air provided to engine cylinders 110.

In some examples, the intake system 104 may further includes a plurality of throttles (e.g., intake throttles) positioned in the plurality of intake runners 134. Specifically, each of the intake runners 134 may include a single throttle positioned therein. Furthermore, each intake runner 134 is in fluidic communication with one of the cylinders 110. In this way, each cylinder has an individual throttle configured to adjust the airflow through each of the runners 134. It will be appreciated that the plurality of throttles may be synchronously controlled. For example, the plurality of throttles may be controlled via a single shaft extending. However, in other examples each throttle may be separately controlled. The controller 150 included in the engine 102 may be used to control operation of the plurality of throttles.

Controller 150 is shown in FIG. 1 as a conventional microcomputer including: microprocessor unit 152, input/output ports 154, read-only memory 156, random access memory 158, keep alive memory 160, and a conventional data bus. Controller 150 is shown receiving various signals from sensors 162 coupled to engine 102, such as a pressure sensor 127, pressure sensor 147, and oxygen sensor 148. The controller 150 may be configured to send signals to actuators 164 such as valve 182, valve 190, and throttle 192. Additionally, instructions for carrying out various routines, such as one or more routines for operating the engine may be stored in the memory of the controller 150.

Turning now to FIGS. 2-9, schematics of an intake assembly with an EGR outlet port (as shown in FIG. 1) enclosed by an EGR outlet port housing are shown. Specifically, FIGS. 2-9 show three-dimensional schematics of portions of an example intake assembly, such as the intake assembly 140 shown in FIG. 1 and including an example EGR outlet port, such as EGR outlet port 178 shown in FIG. 1. FIGS. 2-9 show the relative sizes and positions of the components within the intake assembly 140. FIGS. 2-9 are drawn approximately to scale. As such, the components of the intake assembly 140 shown in FIGS. 2-9 may be the same as the components shown in FIG. 1. Thus, the components of the intake assembly 140 described above with regard to FIG. 1 may not be described in detail again below.

Turning to FIG. 2, a portion of the intake assembly 140 including the EGR outlet port 178 is shown. The EGR outlet port 178 is enclosed by an EGR outlet port housing 210. A portion of the exhaust gases resulting from combustion from the engine is admitted into the intake plenum 118 from an EGR loop, such as EGR loop 170 at FIG. 1, via the EGR outlet port 178. Thus, the EGR outlet port 178 is in fluidic communication with the EGR loop 170 and the intake plenum 118 including a plenum enclosure, such as plenum enclosure 121. An EGR assembly at an outlet end portion of the EGR loop 170 is coupled to the intake housing via the EGR outlet port housing 210. The EGR outlet port housing 210 is contiguous with the intake plenum housing 250. Thus, the EGR outlet port housing is directly and integratively coupled with an intake plenum housing 250. In one example, the EGR port housing may be molded with the intake plenum housing 250 to form a single intake plenum unit. In further embodiments, the single intake plenum unit may be connected to intake runners 134 and ribs 240 may extend along the intake runners 134 and single intake plenum unit. In the present example, the EGR outlet port housing 210 is positioned upstream of one or more intake runners 134 in the direction of intake air flow, and the EGR outlet port 178 opens into an intake plenum enclosure, such as enclosure 121 at FIG. 1. It will be appreciated that the configurations of the EGR outlet port and the EGR outlet port housing (collectively referred to as EGR outlet port configuration) discussed herein may be utilized for coupling any EGR tube assembly, such as a low pressure (LP) EGR tube assembly, with a manifold housing. Specifically, in one example, the EGR outlet port housing configuration may be utilized for attaching a LP-EGR outlet tube assembly with an intake passage housing upstream of a compressor in a LP-EGR circuit. In another example, the EGR outlet port configuration may be applied to an EGR inlet port housing enclosing a high pressure EGR inlet port, such as EGR inlet port 176 that is in communication with an exhaust manifold, such as exhaust manifold 144. In yet another example, the EGR outlet port configuration may be applied to a LP-EGR inlet port housing enclosing an LP-EGR inlet port, such as EGR inlet port 184 in an exhaust passage, such as exhaust passage 149. In general, the EGR outlet port housing configuration discussed in FIGS. 1-9 may be applied to one or more of a HP-EGR inlet port, HP-EGR outlet port, LP-EGR inlet port, and LP-EGR outlet port housings in order to provide improved alignment and faster installation of the EGR tube assembly with the respective manifold and/or plenum. Further, it will be appreciated that the EGR outlet port housing configuration can be utilized for aligning and assembling EGR systems in other engine systems, such as naturally aspirated engines, hybrid engine systems, and super-charged engine systems, in addition to the boosted engine configuration discussed in FIG. 1.

As discussed above, the EGR outlet port housing 210 is configured to receive an EGR tube assembly. The EGR tube assembly may include an EGR outlet assembly and an EGR inlet assembly. An example EGR outlet tube assembly is described below with respect to FIGS. 4 and 5, and an example EGR inlet tube assembly is described with respect to FIGS. 8 and 9.

The EGR outlet port housing 210 includes a central boss 211 extending from the intake plenum housing 250. The central boss 211 extends in a direction 203 along a transverse axis (direction 203 is also referred to herein as transverse axis direction) with respect to a direction 201 of longitudinal axis (direction 201 is also referred to herein as longitudinal axis direction) of intake plenum housing 250. The transverse axis is defined as the axis along a length of the central boss. The length of the central boss is defined as a distance between a back side and a front side of the central boss (when viewed with respect to the EGR port 178; that is, with respect to an observer facing the opening of the EGR port 178). The transverse axis of the central boss 211 lies on a transverse plane perpendicular to the longitudinal axis of the intake plenum housing 250. The central boss 211 encloses the EGR outlet port 178, which opens into the intake plenum enclosure 121.

The EGR outlet port housing 210 further includes EGR tube attachment openings 214 formed on one or more housing extensions 213. The housing extensions 213 are positioned such on opposite sides of the central boss 211. The present example shows a pair of housing extensions 213, each housing extension 213 positioned on opposite sides of the central boss. Each housing extension 213 is configured as a boss with a length extending along transverse planes parallel to the transverse plane containing the transverse axis of the central boss 211. Thus, the housing extensions 213 extend outward from the intake plenum housing along axes parallel to the transverse axis of the central boss 211. The housing extensions 213 including the attachment openings 214 are contiguous with the central boss 211. In one example, the housing extensions 213 may be molded with the central boss 211 to form a single component with central boss and housing extensions. In another example, the housing extensions 213 may be directly coupled to the central boss 211 by a welding process. Each attachment opening 214 is configured to receive a fastener. During installation of an EGR tube assembly with the intake manifold, the attachment openings 214 are aligned with corresponding holes (not shown) on a flange of the EGR tube assembly, and fasteners are used to attach the EGR tube assembly with the EGR outlet port housing 210 via the attachment openings 214.

The present example shows two housing extensions 213, one each on a right side and a left side of the central boss (that is, right side and left side with respect to an observer facing the opening of the central boss 211). However, configurations where the housing extensions 213 are positioned on a top side and a bottom side of the central boss are also within the scope of the disclosure. Some examples may include housing extensions on all four sides of the central boss 211. While the present example shows the EGR outlet port on the lower left side of the intake plenum when viewed from a downstream side (in the direction of air flow) of the intake runners. It will be appreciated that the positioning of the EGR outlet port housing 210 with respect to the intake plenum housing 250 is based on a desired positioning of the EGR tube assembly. Thus, the positioning of the central boss 211 and the housing extensions 213 of the EGR outlet port housing 210 with respect to the intake plenum housing 250 is based on the desired positioning of the EGR tube assembly.

The EGR outlet port housing 210 includes one or more alignment tabs 212 positioned on one side of each housing extension 213. The alignment tabs 212 protrude from the housing extensions 213. In general, a number of alignment tabs 212 are based on a number of housing extensions 213 such that one alignment tab is provided for each housing extension. Thus, each housing extension 213 includes one alignment tab 212 extending from a side of the housing extension 213. In some examples, each housing extension 213 may include at least one alignment tab 212. It will be appreciated that examples where each housing extension 213 includes more than one alignment tab are also within the scope of the disclosure. When more than one alignment tab is included for each housing extension, the alignment tabs may be positioned parallel to each on the same side or opposite sides of the corresponding housing extension.

Each alignment tab 212 is contiguous with the respective housing extension 213. Thus, each alignment tab is directly coupled to the respective housing extension 213. In one example, each alignment tab 212 may be molded to the respective housing extension 213. Thus, the alignment tabs 212, the housing extensions 213 including attachment openings 214, and the central boss 211 may be molded together to form a unitary EGR port housing. Further, in one example, the unitary EGR port housing may be molded with the intake plenum housing to form a unitary intake plenum with EGR port. In another example, the alignment tabs 212, the housing extensions 213 including attachment openings 214, and the central boss 211, may be machine formed as a single piece. In another example, the alignment tabs 212, the housing extensions 213 including attachment openings 214, the central boss 211, and the intake plenum may be machined as a unitary piece. In some examples, one or more of the alignment tabs 212, the housing extensions 213 including attachment openings 214, the central boss 211, and the intake plenum housing 250 may be manufactured as individual units and coupled (through a welding process, for example) together to form an intake plenum housing with an EGR port housing comprising alignment tabs.

Each alignment tab 212 is positioned on a bottom side of the respective housing extension 213 when viewed from the EGR outlet port 178 side with a line of sight along the transverse axis of the central boss 211. An enlarged view of a portion of the intake plenum housing 250 including the EGR outlet port housing 210 is shown in FIG. 3. The alignment tabs 212 will be further described below with respect to FIG. 3. While the present example shows one alignment tab for each housing extension 213, it will be appreciated that examples where there are two alignment tabs for each housing extension 213 (e.g., positioned on opposite sides of the housing extension, such a bottom side and a top side) are also within the scope of the disclosure. The alignment tabs 212, when provided on the top side and bottom side of each housing extension 213, may provide dual guidance and restrict movement of the EGR tube assembly in both upward and downward direction, thereby improving alignment of the EGR tube assembly with the EGR port housing.

Turning to FIG. 3, each alignment tab 212 is configured as a planar wall extension of the housing extension 213 with a desired thickness. The desired thickness is less than a diameter of the housing extension 213. Each alignment tab 212 extends vertically downwards from the housing extension 213. In particular, each alignment tab extends vertically downwards from an outer wall of the housing extension 213. Thus, each alignment tab 212 is contiguous with the corresponding housing extension 213. In one example, the desired thickness may be based on a thickness of a wall of the housing extension 213. Each alignment tab 212 is coupled to the intake plenum housing 250 and the corresponding housing extension 213. In one example, each alignment tab 212 is coupled to the intake plenum housing 250 such that the back wall of each alignment tab 212 (with respect to an observer facing the EGR port 178) is contiguous with the intake plenum housing 250. Specifically, each alignment tab 212 may be directly coupled with the intake plenum housing 250 such that the back wall of the alignment tab 212 is contiguous with an outer wall of the intake plenum housing 250. Further, the top wall of each alignment tab 212 (with respect to an observer facing the EGR port 178) is contiguous with an outer wall of the housing extension 213.

In one example, each alignment tab 212 may be positioned with respect to the corresponding housing extension 213 such that the alignment tab 212 extends vertically below the center along a central axis 307 of the corresponding housing extension 213. The central axis 307 is perpendicular to the transverse axis of the central boss 211. In such cases, each alignment tab 212 may be directly coupled with the intake plenum housing 250 such that the top wall of the alignment tab 212 is contiguous with a bottom portion of the outer wall of the corresponding housing extension 213. In another example, the alignment tab 212 is slightly offset from the central axis 307 of the corresponding housing extension 213. In yet another example, when the alignment tab 212 is offset from the central axis, the top wall of the alignment tab 212 may be contiguous with a bottom-outer side edge of the corresponding housing extension 213. As a result, the outer wall of the housing extension 213 continues downwards to form a side wall of each alignment tab 212. In some examples, one alignment tab may be configured with the top wall contiguous with a bottom portion of the housing extension 213 while a second alignment tab may be configured with the top wall contiguous with the bottom-outer side portion of the housing extension. That is, one alignment tab may be positioned along the central axis 307 of the housing extension 213 while the second alignment tab may be positioned offset from the central axis of the housing extension 213. Further, the positioning of the alignment tab 212 with respect to the housing extension 213 may be based on a position of a flange attachment plate mounting tab (discussed with respect to FIG. 4 below). For example, the alignment tab may be positioned such that when a flange attachment plate is mounted on the assembled EGR outlet assembly, the alignment tabs are on the outside with respect to the mounting tabs on the flange attachment plates.

Each alignment tab 212 includes a step-like protrusion 303 on a front side. The step-like protrusion 303 extends in front of an outer-front rim of the housing extension 213. Said another way, the step-like protrusion 303 extends outward beyond of a front face of the housing extension 213. The step-like protrusion has a first planar surface 302 and a second planar surface 301. In one example, the first planar surface 302 and the second planar surface are perpendicular to each other. Further, in one example, the first planar surface 302 may be horizontal lying parallel to the transverse axis of the central boss 211. In some examples, the first planar surface 302 may not be parallel to the transverse axis. In such cases, the first planar surface 302 may slope downwards (with respect to an observer facing the EGR port 178)

from an edge wall of the housing extension 213. The first planar surface 302 is configured to enable correct positioning and alignment of a flange of the EGR tube assembly such that holes on the flange of the EGR tube assembly align with the attachment openings 214. A length of the first planar surface determines the amount of protrusion of the step-like protrusion. In one example, the length of the first planar surface may be greater than a thickness of the flange and a flange plate of the EGR tube assembly.

The step-like protrusion may be utilized as a guide for positioning an EGR tube assembly on the alignment tab 212 and moving the EGR tube assembly along the first planar surface 302 until the flange of the EGR tube assembly is in face-sharing contact with the outer front surface of the housing extensions 213 and the holes on the flange align with the attachment openings 214 of the housing extensions 213. In this way, during installation, the EGR tube assembly is properly positioned and aligned with the EGR outlet port housing with the help of EGR tube alignment tabs 212. Subsequently, the EGR tube assembly is fastened (with bolts, for example) with the intake plenum via EGR tube attachment openings 214 on the EGR outlet port housing and the holes on the flange.

Figure 4:
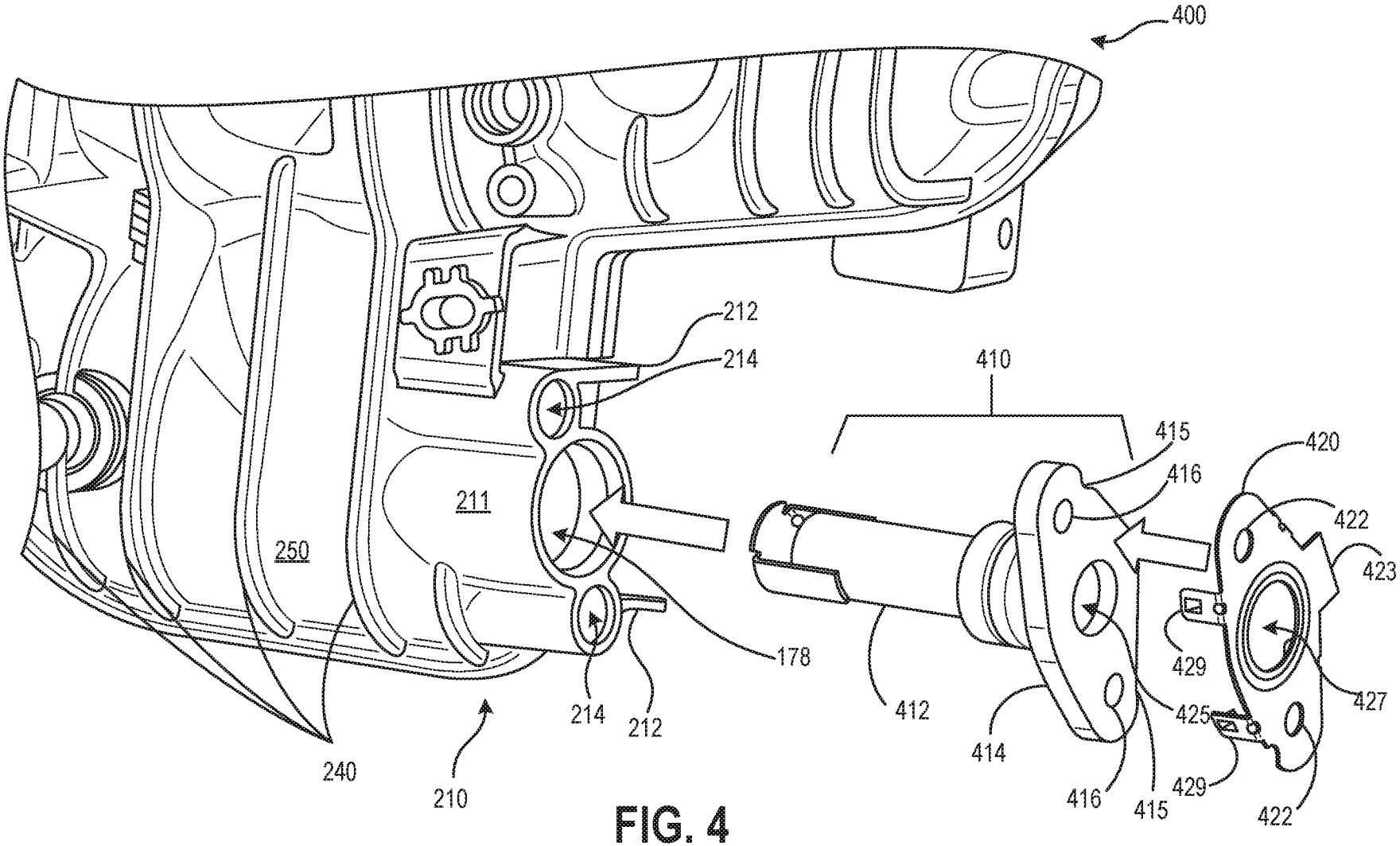
FIG. 4 shows an exploded view of a portion of the engine intake assembly including the EGR port housing of FIG. 2, and an EGR outlet assembly.

Turning to FIG. 4, an exploded view of a portion 400 of the intake plenum 118 including the EGR outlet port housing 210, and an EGR outlet assembly 410 is shown. The EGR outlet assembly 410 includes an EGR outlet tube 412 that is inserted into the EGR outlet port 178 formed by the EGR outlet port housing 210. The EGR outlet assembly 410 further includes an EGR outlet flange 414 coupled to the EGR outlet tube 412 on one end of the EGR outlet tube. The EGR outlet flange 414 includes a central opening 425 with a diameter based on the EGR tube diameter. When assembled, the central opening 425 is in alignment with the EGR tube such that during operation, the EGR may flow without obstruction into the EGR outlet port 178. The EGR outlet flange 414 further includes fastener holes 416 for receiving fasteners. The EGR outlet flange 414 further includes a groove 415 on a right bottom surface and a left bottom surface. The grooves 415 allow positioning and alignment of the EGR outlet assembly 410 onto the alignment tabs 212.

During installation, the EGR outlet assembly 410 is aligned and fitted into the EGR outlet port housing 210 in the intake plenum housing 250 with the alignment tabs 212 on the EGR outlet port housing 210. Specifically, the EGR outlet tube 412 of the assembly 410 is inserted into the central boss 211 of the EGR outlet port housing 210, and the EGR outlet flange 414 of the assembly 410 is adjusted such that the grooves 415 on the bottom surface rest on the respective alignment tabs 212. Particularly, the grooves 415 are positioned on the first planar surface of the step-like protrusion 303 of the alignment tab. Subsequently, the EGR outlet assembly 410 is pushed to fit into the central boss 211 such that the outer surface of the EGR port housing 210 and a back surface of the flange 414 (when viewed with respect to an observer facing the EGR port 178) are in direct face sharing contact. By utilizing the alignment tabs 212 for positioning and fitting the EGR outlet assembly, the attachment openings 214 of the EGR outlet port housing 210 and the fastener holes 416 on the EGR outlet assembly 410 are aligned. Particularly, the alignment tabs 212, both independently and in combination with the grooves 415, enable directional positioning of the EGR outlet assembly 410. For example, due to the presence of the alignment tabs, when an attempt is made to install the EGR outlet assembly at a 180 degree rotated position (that is, if bottom side is incorrectly positioned on top and vice-versa), the attachment openings 214 and the fastener holes 416 do not align. That is, since the alignment tab 212 determines the positioning of the flange 414 of the EGR outlet assembly with respect to the EGR outlet port housing, if the EGR outlet assembly is incorrectly positioned, a portion of the flange 414 may block the attachment openings 214, thereby resulting in misalignment of the attachment openings 214 on the EGR outlet port housing 210 and the fastener holes 416 on the flange 414 of the EGR outlet assembly. Consequently, a fastener may not pass completely through the fastener holes 416 and the attachment openings 214. As a result, when the EGR outlet assembly is incorrectly positioned with respect to the EGR outlet port housing 210, it may not be possible to fasten the EGR outlet assembly with the intake plenum. Thus, improper installation of the EGR outlet assembly is prevented by using the alignment tabs.

In this way, by utilizing the alignment tabs 212, directional positioning of the EGR outlet assembly is achieved. As a result, faster and correct installation of the EGR outlet assembly is achieved.

Figure 5:
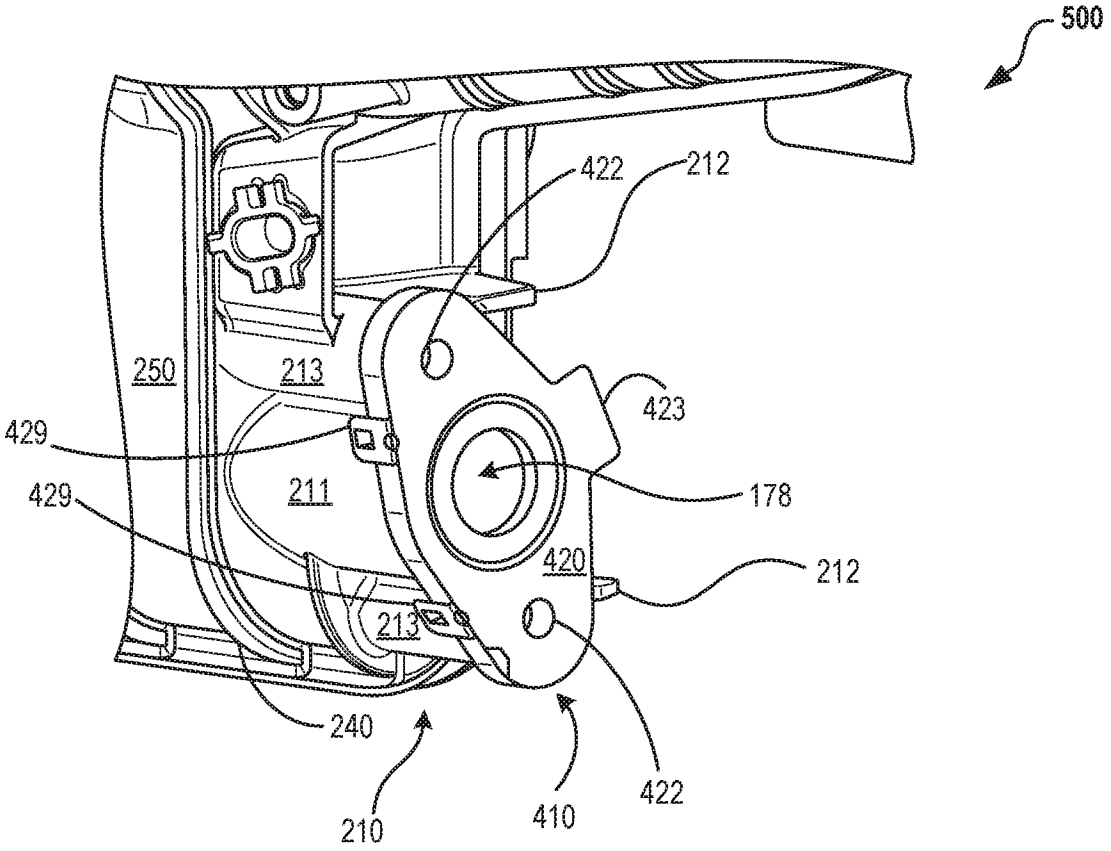
FIG. 5 shows a perspective view of an assembled engine intake assembly and EGR outlet assembly unit.

Subsequently, upon fitting the EGR outlet assembly 410 into the EGR outlet port housing 210, a flange attachment plate 420, which includes fastener holes 422, is positioned on the front surface (when viewed with respect to an observer facing the EGR port 178) of the flange 414 such that the fastener holes 422 are in alignment with the fastener holes 416 on the flange 414 and attachment openings 214 on the EGR outlet port housing 210. The flange attachment plate 420 further includes a positioning tab 423 for aligning the flange attachment plate 420 with the EGR outlet assembly. For example, the positioning tab 423 may indicate a bottom side of the flange attachment plate 420. The flange attachment plate 420 further includes an opening 427 corresponding to the central opening 425 of the EGR outlet assembly 410. The flange attachment plate 420 further includes a pair of mounting tabs 429 on a top side of the attachment plate 420 for clasping a top side of the flange 414, and may include a second pair of mounting tabs (not shown) on a bottom side of the attachment plate 420 for clasping a bottom side of the flange 414. When assembled, a front surface of the flange 414 of the EGR outlet assembly 410 and a back surface of the flange attachment plate are in direct face-sharing contact. The assembled EGR outlet assembly 410 and the attachment plate 420 with the EGR outlet port housing 210 is shown in FIG. 5. As shown in FIG. 5, when properly assembled, the fastener holes 422 of the plate 420 and the fastener holes 416 of the flange 414 are in alignment with the attachment openings 214. That is, the attachment openings 214 are not blocked by the flange 414.

Figure 6:
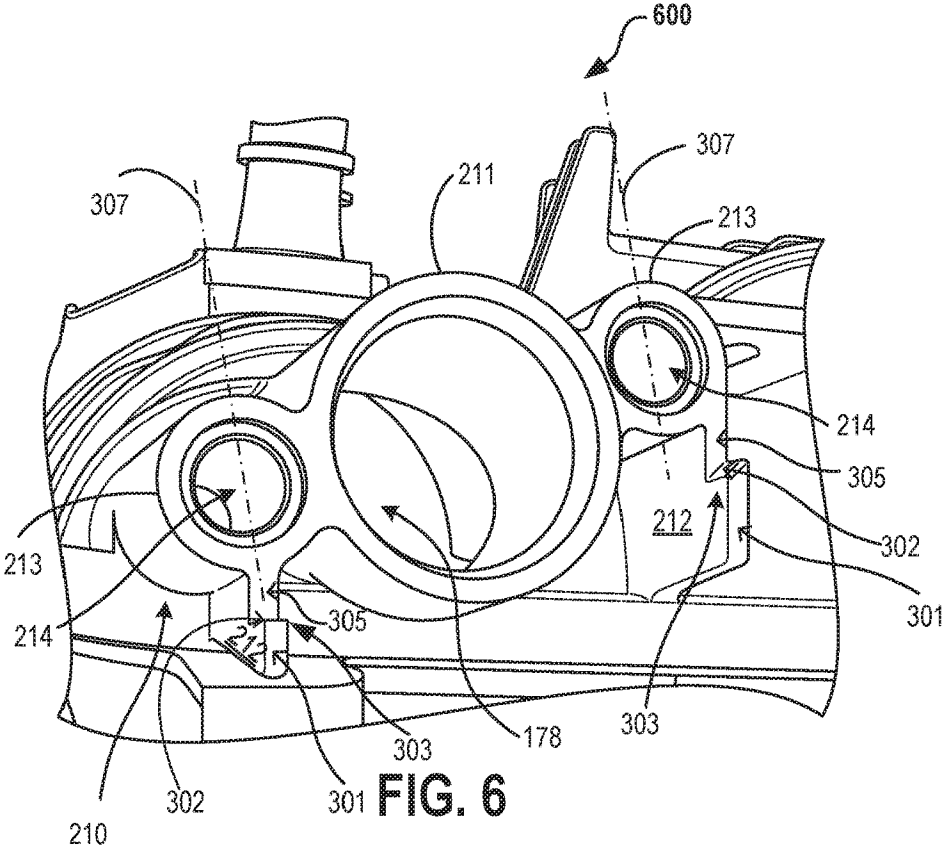
FIG. 6 shows another perspective view of a portion of the engine intake assembly and the EGR port housing of FIG. 2.

FIG. 6 shows a second perspective view 600 of a portion of the intake plenum housing 250 including the EGR outlet port housing 210. As discussed above, the EGR outlet port housing 210 includes a pair of alignment tabs 212 on either side of the central boss 211 to enable directional positioning and correct alignment of the EGR outlet assembly with the EGR outlet port housing 210. As shown, the outer wall of each housing extension 213 extends downwards vertically (when viewed with respect to the EGR outlet port 178; that is, facing the EGR outlet port 178) to form the alignment tabs 212. In one example, the alignment tab 212 is slightly offset from a central axis 307 of the housing extension 213. In another example, the alignment tab 212 extends below the center along the central axis 307 of the housing extension 213. Further, as discussed above, with respect to FIG. 3, each alignment tab 212 includes a step-like protrusion 303 on a front side of the alignment tab 212 (when viewed with respect to the EGR outlet port 178). The step-like protrusion 303 comprises of a first planar surface 302 and a second planar surface 301 forming the step. The step may be positioned in the upper portion of the alignment tab. Thus, the front side of each alignment tab 212 may be configured such that a first upper portion 305 is continuous with the housing extension (a front surface of the housing extension and a front surface of the first upper portion lie along the same plane) until the step-like protrusion 303. The first planar surface 302 of the step-like protrusion extends in front of the first upper portion at a right angle. In some examples, the first planar surface 302 may be positioned at an obtuse angle with respect to the front surface of the first upper portion. The first planar surface 302 of the step-like protrusion provides guidance for positioning and alignment of an EGR assembly. The second planar surface 301 extends below the first planar surface 302, and provides additional support to the first planar surface. In one example, the second planar surface 301 may be positioned on a parallel plane with respect to the front surface of the first upper portion. In another example, the second planar surface 301 may be inclined at an acute angle with respect to the first planar surface 302. The second planar surface 301 and a bottom side of the alignment tab 212 forms the base support structure of the step-like protrusion. While the present example shows a rectangular base support structure. In some examples, the base support structure may be triangular. In such examples, one side of the second planar surface 301 may be coupled to the edge of the first planar surface and a second side of the second planar surface may be coupled to the intake plenum housing 250.

Figure 7:
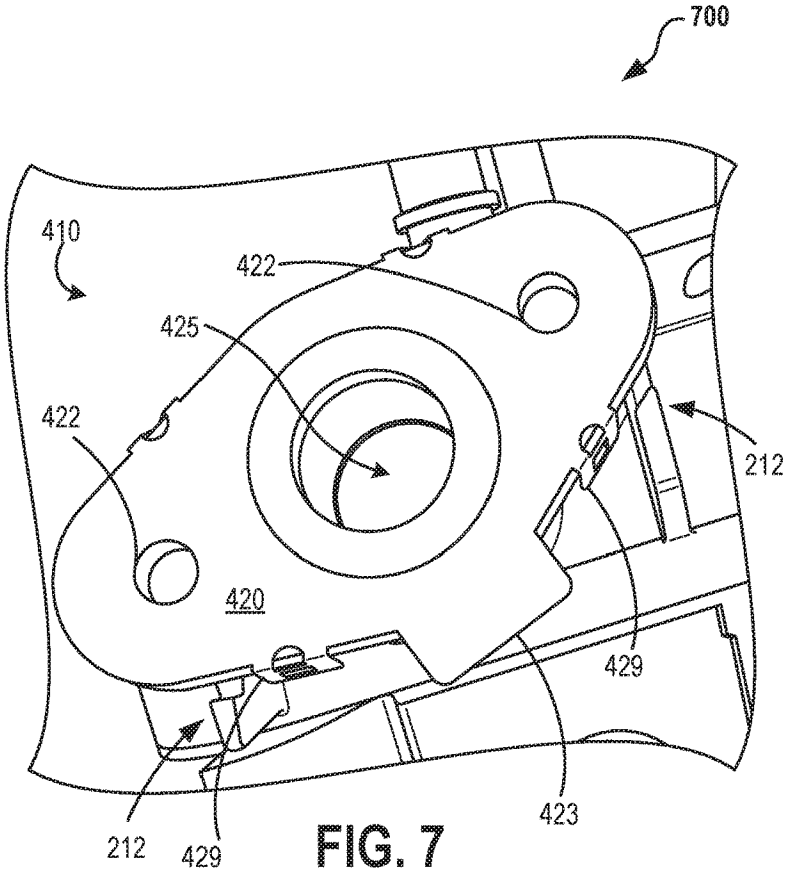
FIG. 7 shows another perspective view of the assembled engine intake assembly and EGR outlet assembly unit of FIG. 5.

As discussed above with respect to FIG. 4, during an assembling process, the alignment tabs 212 provide a surface for positioning the EGR outlet assembly (particularly, the flange of the EGR assembly) and guide the EGR outlet assembly into the correct position such that the fastener holes on the EGR outlet assembly align with the attachment openings on the EGR outlet port housing, and the EGR outlet assembly is mounted flush with the EGR outlet port housing. A second perspective view 700 of the assembled EGR outlet assembly 410 with the EGR outlet port housing 210 is shown in FIG. 7. In this way, the pair of alignment tabs on the EGR outlet port housing provide positioning and alignment for faster and correct installation of the EGR assembly into the EGR outlet port. In addition, the alignment tabs prevent incorrect installation of the EGR assembly. For example, if the EGR outlet assembly is rotated and in an incorrect position, the alignment tabs do not allow the EGR outlet assembly to mount flush to the surface of the EGR outlet port housing. As a result, the fastener holes on the EGR outlet assembly do not align with the attachment openings on the EGR outlet port housing, which prevents incorrect installation of the EGR outlet assembly.

Figure 8:
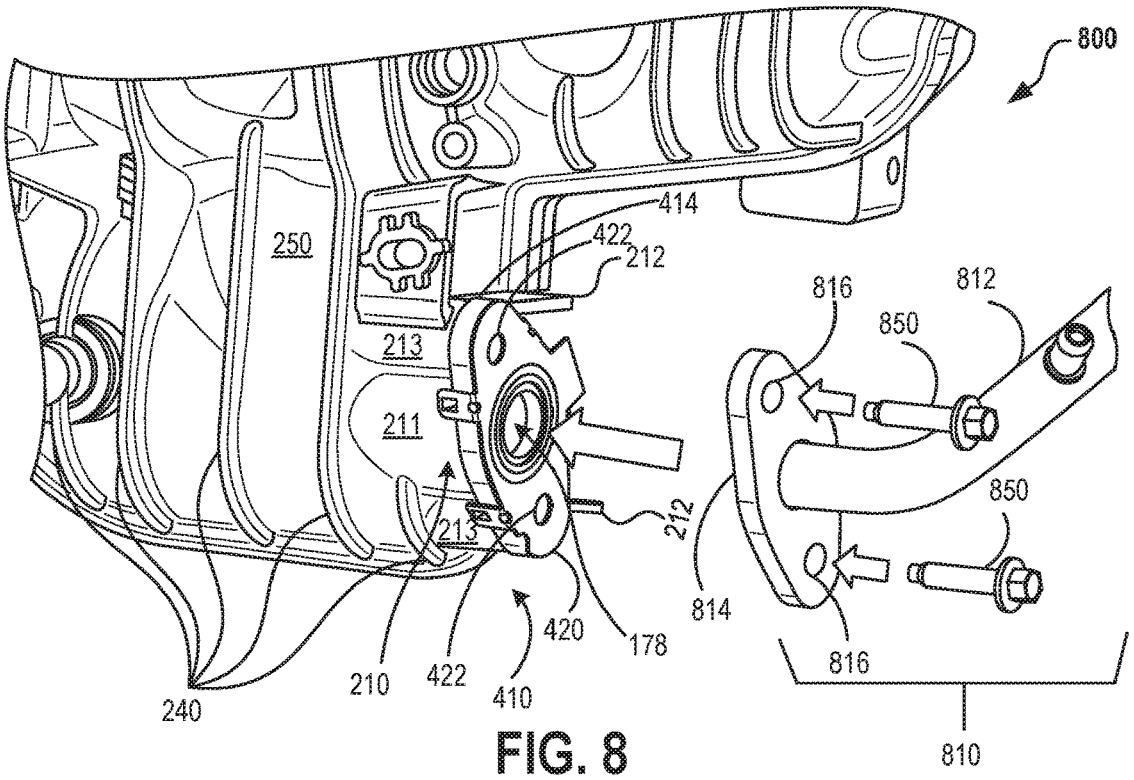
FIG. 8 shows an exploded view of a portion of the engine intake assembly including assembled engine intake assembly and EGR outlet assembly unit of FIG. 5, and an EGR inlet assembly.
Figure 9:
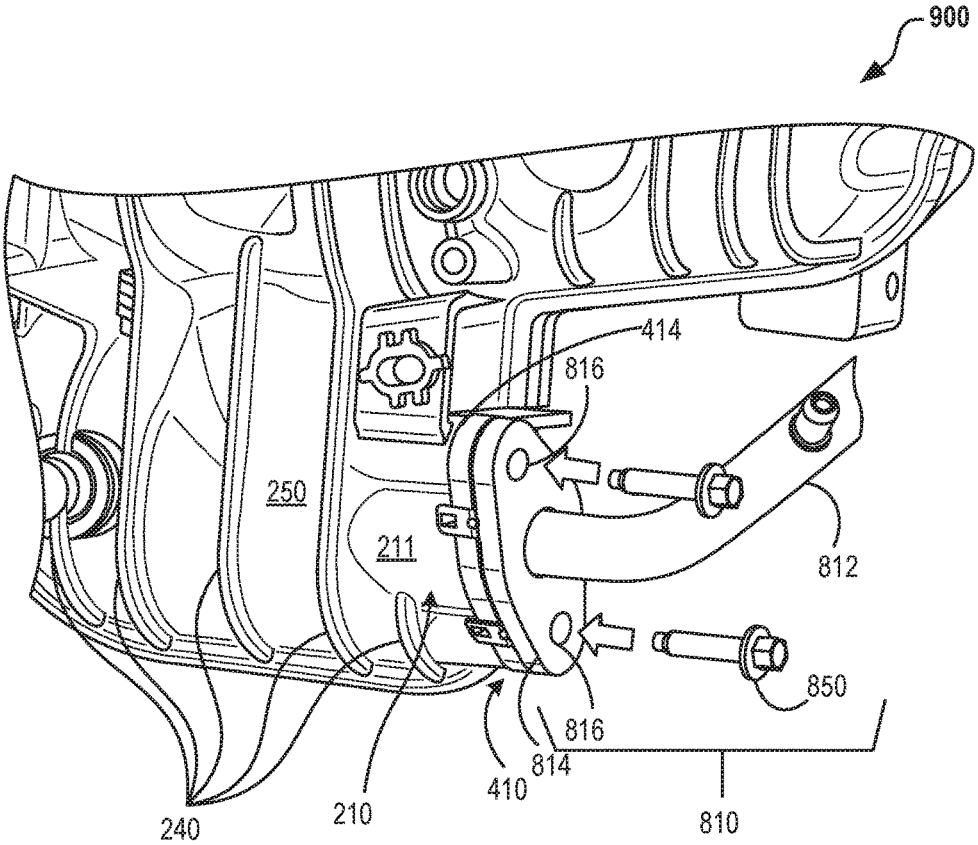
FIG. 9 shows a perspective view of an assembled engine intake assembly, EGR outlet assembly, and EGR inlet assembly unit.

Further, as discussed at FIG. 4, upon mounting the EGR outlet assembly with the EGR outlet port housing, a flange attachment plate 420 is mounted on the EGR outlet flange. Subsequently, an EGR inlet assembly is mounted with the assembled EGR outlet assembly 410 and flange attachment plate 420. An exploded view 800 of the assembled EGR outlet assembly 410 and flange attachment plate 420, and an EGR inlet assembly 810 is shown at FIG. 8. An assembled EGR assembly including the EGR outlet assembly 410 and the EGR inlet assembly is shown at FIG. 9.

Turning to FIG. 8, the EGR inlet assembly 810 includes an EGR inlet tube 812 and an EGR inlet tube flange 816. During EGR tube assembly process, the EGR inlet assembly 810 is positioned on the assembled EGR outlet assembly 410 and flange attachment plate 420 unit and adjusted such that fastener holes 816 on the EGR inlet flange 814 are in alignment with the aligned fastener holes 416 and attachment openings 214. In one example, the alignment tabs 212 on the EGR outlet port housing 210 provide positioning guidance and alignment for the EGR inlet assembly. For example, the step-like protrusions on the alignment tabs 212 extend beyond the assembled EGR outlet assembly and flange attachment plate 420 unit so as to allow positioning of the EGR inlet tube flange 814 on the step-like protrusions of the alignment tabs on either side of the EGR. Once positioned on the alignment tabs 212, the EGR inlet tube assembly 810 is guided via the alignment tabs 212 to align the holes 816, 416, and 214 on the EGR inlet tube assembly 810, the EGR outlet tube assembly 410, and the EGR outlet port housing 210 respectively. When aligned and positioned correctly, central transverse axes of the holes 816, 416, and 214 are aligned, and a back surface of the EGR inlet flange 814 is in direct face-sharing contact with flange attachment plate 420. Upon aligning and positioning the EGR inlet tube assembly 810, the EGR outlet tube assembly 410, and the EGR outlet port housing 210 via the alignment tabs 212, fasteners 850 may be used to couple the EGR inlet tube assembly 810, the EGR outlet tube assembly 410, and the EGR outlet port housing 210. When the EGR inlet assembly is incorrectly positioned (e.g., rotated 180 degrees from the desired position), the holes 816 do not align with the holes 416 and openings 214 of the EGR outlet assembly and the EGR outlet port housing, and the flange 816 partly blocks the holes 416 and openings 214. As a result, fasteners 850 cannot pass through the holes and openings to couple the inlet assembly.

In this way, alignment tabs 212 on the EGR outlet port housing 210 provide positioning and alignment guidance for faster and correct installation of one or more EGR assemblies including the EGR outlet assembly and the EGR inlet assembly. Additionally, the alignment tabs 212 do not allow the one or more EGR assemblies to mount when positioned incorrectly.

FIGS. 2-9 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

As one embodiment an intake system for an engine includes an intake plenum enclosed by an intake plenum housing; and an exhaust gas recirculation (EGR) port for admitting exhaust gases recirculated by an EGR system into the intake plenum; wherein the EGR port is enclosed by an EGR port housing including a central boss, one or more housing extensions, and one or more alignment tabs, each alignment tab positioned on one side of each housing extension. In a first example the intake system includes wherein the EGR port housing is contiguous with the intake plenum housing extending outward from the intake plenum housing; and wherein each alignment tab includes a step-like protrusion on a front side of the alignment tab. A second example of the intake system optionally includes the first example and further includes wherein the step-like protrusion extends outward beyond a front face of the corresponding housing extension, and wherein the step-like protrusion includes a first planar surface and a second planar surface. A third example of the intake system optionally includes one or more of the first and second examples, and further includes wherein the first planar surface is parallel to a transverse axis of the central boss and perpendicular to the second planar surface. A fourth example of the intake system optionally includes one or more of the first through third examples, and further includes, wherein each alignment tab is coupled to the intake housing and the corresponding housing extension on a on a back side and a top side of the alignment tab respectively such that the back side is contiguous with the intake housing and the top side is contiguous with a bottom portion of the corresponding housing extension; and wherein a left side surface and a right side surface of each alignment tab are planar and perpendicular to the intake plenum housing. A fifth example of the intake system optionally includes one or more of the first through fourth examples, and further includes, wherein each housing extension is configured as a boss with an opening and positioned on opposite sides of the central boss; and wherein a thickness of the alignment tab is less than a diameter of the opening. A sixth example of the intake system optionally includes one or more of the first through fifth examples, and further includes, wherein one or more of the alignment tabs are positioned along a central axis of the corresponding housing extension, the central axis perpendicular to a transverse axis of the central boss. A seventh example of the intake system optionally includes one or more of the first through sixth examples, and further includes, wherein one or more of the alignment tabs are positioned offset from a central axis of the corresponding housing extension, the central axis perpendicular to a transverse axis of the central boss. An eighth example of the intake system optionally includes one or more of the first through seventh examples, and further includes, an EGR assembly coupled to EGR port housing, wherein the EGR assembly includes an EGR outlet tube disposed within the EGR port, and an EGR tube flange in face-sharing contact with a front surface of the EGR port housing and positioned above the one or more alignment tabs; and wherein the EGR tube flange includes one or more mounting grooves on a bottom side, each of the mounting grooves aligned with the corresponding alignment tab. A ninth example of the intake system optionally includes one or more of the first through eighth examples, and further includes, wherein the EGR port is a high-pressure EGR port positioned downstream of a compressor, the compressor located in an intake passage upstream of the intake plenum, the compressor delivering compressed air to the engine via the intake plenum.

As another embodiment, an exhaust gas recirculation (EGR) port for a manifold, includes: an EGR port housing including a central boss, a pair of housing extensions, each including an opening and positioned on opposite sides of the central boss, and a pair of alignment tabs; wherein each alignment tab is positioned on at least one side of each housing extension. In a first example, the EGR port includes wherein the EGR port housing is integratively coupled with a manifold housing; and wherein each alignment tab extends from an outer wall of the manifold housing along a length of the corresponding housing extension and beyond a front face of the corresponding housing extension. A second example of the EGR port optionally includes the first example and further includes wherein each alignment tab is positioned below the corresponding housing extension; and wherein each alignment tab includes a step-like protrusion on a front side of the alignment tab. A third example of the EGR port optionally includes one or more of the first and second examples, and further includes wherein the step-like protrusion extends outward beyond a front face of the corresponding housing extension, and includes a first planar surface and a second planar surface; and wherein a back side of each alignment tab is contiguous with the intake housing and the top side is contiguous with a bottom portion of the corresponding housing extension. A fourth example of the EGR port optionally includes one or more of the first through third examples, and further includes, wherein the EGR port housing is coupled to an EGR assembly; wherein the EGR assembly includes an EGR tube disposed within the EGR port, and an EGR tube flange in face-sharing contact with a front surface of the EGR port housing and positioned above the pair of alignment tabs; and wherein the EGR tube flange includes a pair of mounting grooves on a bottom side, each of the mounting grooves aligned with the corresponding alignment tab. A fifth example of the EGR port optionally includes one or more of the first through fourth examples, and further includes, wherein one or more of the pair of alignment tabs are positioned along a central axis of the corresponding housing extension, the central axis perpendicular to a transverse axis along a length of the central boss. A sixth example of the EGR port optionally includes one or more of the first through fifth examples, and further includes, wherein one or more of the pair of alignment tabs are positioned offset from a central axis of the corresponding housing extension, the central axis perpendicular to a transverse axis a length of the central boss. A seventh example of the EGR port optionally includes one or more of the first through third examples, and further includes, wherein the manifold housing encloses an intake manifold of an engine, and the EGR port housing encloses an EGR outlet port for admitting exhaust gases from the engine recirculated into the intake manifold.

As another embodiment, an engine system, includes: an engine including a plurality of cylinders; an intake manifold on an intake side of the engine for delivering intake air to the engine, the intake manifold enclosed by an intake manifold housing; and an exhaust gas recirculation (EGR) system including an EGR tube assembly for recirculating a portion of exhaust gases into the intake manifold; wherein the intake manifold housing includes an EGR outlet port housing for coupling the EGR tube assembly with the intake manifold; and wherein the EGR outlet port housing includes one or more alignment tabs for aligning the EGR tube assembly with the EGR outlet port housing port. In a first example, the engine system includes wherein the EGR outlet port housing further includes a central boss, and each of a pair of housing extensions on opposite sides of the central boss; wherein each alignment tab is positioned below each housing extension; wherein each alignment tab is configured as a planar wall with a step-like protrusion on a front side of the alignment tab, the step-like protrusion extending outward beyond a front face of the corresponding housing extension; and wherein a back side of each alignment tab is contiguous with the intake manifold housing and a top side is contiguous with a bottom portion of the corresponding housing extension.

As another representation, a method for assembling an engine includes aligning an exhaust gas recirculation (EGR) tube assembly with an EGR outlet port housing via one or more alignment tabs on the EGR outlet port housing; and coupling the EGR tube assembly with the EGR outlet port housing; wherein the engine includes a plurality of cylinders, an intake manifold on an intake side of the engine for delivering intake air to the engine, the intake manifold enclosed by an intake manifold housing, and an exhaust gas recirculation (EGR) system including the EGR tube assembly for recirculating a portion of exhaust gases into the intake manifold; and wherein the intake manifold housing includes the EGR outlet port housing for coupling the EGR tube assembly with the intake manifold. In a first example, the method includes wherein the EGR outlet port housing further includes a central boss, and each of a pair of housing extensions on opposite sides of the central boss; wherein each alignment tab is positioned below each housing extension; wherein each alignment tab is configured as a planar wall with a step-like protrusion on a front side of the alignment tab, the step-like protrusion extending outward beyond a front face of the corresponding housing extension; and wherein a back side of each alignment tab is contiguous with the intake manifold housing and a top side is contiguous with a bottom portion of the corresponding housing extension. A second example of method optionally includes the first example and further includes wherein the EGR outlet port is a high-pressure EGR port positioned downstream of a compressor, the compressor located in an intake passage upstream of the intake manifold, the compressor delivering compressed air to the engine via the intake manifold. A third example of the method optionally includes one or more of the first and second examples, and further includes wherein the one or more alignment tabs are positioned along a central axis of the corresponding housing extension, the central axis perpendicular to a transverse axis of the central boss. A fourth example of the method optionally includes one or more of the first through third examples, and further includes, wherein the one or more of the alignment tabs are positioned offset from a central axis of the corresponding housing extension, the central axis perpendicular to a transverse axis of the central boss.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An intake system for an engine, comprising:

an intake plenum enclosed by an intake plenum housing;

an exhaust gas recirculation (EGR) port for admitting exhaust gases recirculated by an EGR system into the intake plenum, the EGR port enclosed by an EGR port housing including a central boss, one or more housing extensions, and one or more alignment tabs, each alignment tab positioned on one side of each housing extension; and an EGR assembly coupled to the EGR port housing, wherein the EGR assembly includes an EGR outlet tube disposed within the EGR port and an EGR tube flange in face-sharing contact with a front surface of the EGR port housing and positioned above the one or more alignment tabs; and wherein the EGR tube flange includes one or more mounting grooves on a bottom side, each of the mounting grooves aligned with the corresponding alignment tab.

2. The intake system of claim 1, wherein the EGR port housing is contiguous with the intake plenum housing, extending outward from the intake plenum housing; and wherein each alignment tab includes a step-like protrusion on a front side of the alignment tab.

3. The intake system of claim 2, wherein the step-like protrusion extends outward beyond a front face of the corresponding housing extension, and wherein the step-like protrusion includes a first planar surface and a second planar surface.

4. The intake system of claim 3, wherein the first planar surface is parallel to a transverse axis of the central boss and perpendicular to the second planar surface.

5. The intake system of claim 1, wherein each alignment tab is coupled to the intake housing and the corresponding housing extension on a back side and a top side of the alignment tab respectively such that the back side is contiguous with the intake housing and the top side is contiguous with a bottom portion of the corresponding housing extension; and wherein a left side surface and a right side surface of each alignment tab are planar and perpendicular to the intake plenum housing.

6. The intake system of claim 1, wherein each housing extension is configured as a boss with an opening and positioned on opposite sides of the central boss; and wherein a thickness of the alignment tab is less than a diameter of the opening.

7. The intake system of claim 1, wherein one or more of the alignment tabs are positioned along a central axis of the corresponding housing extension, the central axis perpendicular to a transverse axis of the central boss.

8. The intake system of claim 1, wherein one or more of the alignment tabs are positioned offset from a central axis of the corresponding housing extension, the central axis perpendicular to a transverse axis of the central boss.

9. The intake system of claim 1, wherein the EGR port is a high-pressure EGR port positioned downstream of a compressor, the compressor located in an intake passage upstream of the intake plenum, the compressor delivering compressed air to the engine via the intake plenum.

10. An exhaust gas recirculation (EGR) port for a manifold, comprising:

an EGR port housing including a central boss, a pair of housing extensions, each housing extension including a central opening, the housing extensions positioned on opposite sides of the central boss, and a pair of alignment tabs;

wherein each alignment tab is positioned on at least one side of each housing extension, and wherein the housing extensions and the EGR port terminate at a common surface defining the central openings and an opening of the EGR port housing wherein the EGR port housing is coupled to an EGR assembly, and the EGR assembly includes an EGR tube disposed within the EGR port and an EGR tube flange in face-sharing contact with a front surface of the EGR port housing.

11. The EGR port of claim 10, wherein the EGR port housing is integratively coupled with a manifold housing; and wherein each alignment tab extends from an outer wall of the manifold housing along a length of the corresponding housing extension and beyond a front face of the corresponding housing extension.

12. The EGR port of claim 10, wherein each alignment tab is positioned below the corresponding housing extension; and wherein each alignment tab includes a step-like protrusion on a front side of the alignment tab.

13. The EGR port of claim 12, wherein the step-like protrusion extends outward beyond a front face of the corresponding housing extension, and includes a first planar surface and a second planar surface; and wherein a back side of each alignment tab is contiguous with the manifold and a top side is contiguous with a bottom portion of the corresponding housing extension.

14. The EGR port of claim 13, wherein the EGR tube flange is positioned above the pair of alignment tabs; and wherein the EGR tube flange includes a pair of mounting grooves on a bottom side, each of the mounting grooves aligned with the corresponding alignment tab.

15. The EGR port of claim 10, wherein one or more of the pair of alignment tabs are positioned along a central axis of the corresponding housing extension, the central axis perpendicular to a transverse axis along a length of the central boss.

16. The EGR port of claim 10, wherein one or more of the pair of alignment tabs are positioned offset from a central axis of the corresponding housing extension, the central axis perpendicular to a transverse axis a length of the central boss.

17. The EGR port of claim 10, wherein a manifold housing encloses an intake manifold of an engine, and the EGR port housing encloses an EGR outlet port for admitting exhaust gases from the engine recirculated into the intake manifold.

18. The EGR port of claim 10, wherein the manifold is an intake manifold with a plurality of runners, wherein the central boss and the pair of housing extensions are in contact with one another along an entire length of the central boss, wherein the central boss and the pair of housing extensions are formed in the manifold and positioned upstream of each of the runners.

19. An engine system, comprising:

an engine including a plurality of cylinders;

an intake manifold on an intake side of the engine for delivering intake air to the engine, the intake manifold enclosed by an intake manifold housing; and an exhaust gas recirculation (EGR) system including an EGR tube assembly for recirculating a portion of exhaust gases into the intake manifold;

wherein the intake manifold housing includes an EGR outlet port housing for coupling the EGR tube assembly with the intake manifold, the EGR outlet port housing including a central boss and a pair of housing extensions, each housing extension including a central opening, the housing extensions positioned on opposite sides of the central boss and wherein the housing extensions and the EGR outlet port housing terminate at a common surface defining the central openings and an opening of the EGR outlet port housing; and wherein the EGR outlet port housing includes one or more alignment tabs for aligning the EGR tube assembly with the EGR outlet port housing, the EGR system including an EGR flange in face-sharing contact with the common surface.

20. The system of claim 19, wherein the EGR outlet port housing further includes the central boss, and each of the pair of housing extensions on opposite sides of the central boss; wherein each alignment tab is positioned below each housing extension; wherein each alignment tab is configured as a planar wall with a step-like protrusion on a front side of the alignment tab, the step-like protrusion extending outward beyond a front face of the corresponding housing extension; and wherein a back side of each alignment tab is contiguous with the intake manifold housing and a top side is contiguous with a bottom portion of the corresponding housing extension.

* * * * *